US005749947A

United States Patent [19]

Geke et al.

[11] Patent Number: 5,749,947

[45] Date of Patent: May 12, 1998

[54] USE OF GUANIDINIUM SALTS OF UNSATURATED FATTY ACIDS AS CORROSION INHIBITORS

[75] Inventors: Juergen Geke, Duesseldorf; Horst-Dieter Speckmann, Langenfeld; Bernd Stedry, Kempen; Alfred Westfechtel, Hilden, all of Germany

[73] Assignee: Henkel Kommanditgesellschaft auf Aktien, Duesseldorf, Germany

[21] Appl. No.: 817,458

[22] PCT Filed: Oct. 5, 1995

[86] PCT No.: PCT/EP95/03931

§ 371 Date: Apr. 14, 1997

§ 102(e) Date: Apr. 14, 1997

[87] PCT Pub. No.: WO96/12054

PCT Pub. Date: Apr. 25, 1996

[30] Foreign Application Priority Data

Oct. 14, 1994 [DE] Germany ..... 44 36 764.3

[51] Int. Cl.[6] ..... C09D 5/08; C23F 11/14; C23F 11/10

[52] U.S. Cl. ..... 106/14.42; 106/14.15; 106/14.31; 106/14.37; 106/285; 252/394; 208/14

[58] Field of Search ..... 106/14.05, 14.15, 106/14.31, 14.42, 14.37, 285; 252/394; 208/14

[56] References Cited

U.S. PATENT DOCUMENTS

| | | | |
|---|---|---|---|
| 2,978,415 | 4/1961 | Chamberlain | 252/118 |
| 5,286,397 | 2/1994 | Schmid et al. | 252/56 S |
| 5,318,954 | 6/1994 | Mueller et al. | 507/138 |
| 5,403,822 | 4/1995 | Mueller et al. | 507/138 |

FOREIGN PATENT DOCUMENTS

| | | |
|---|---|---|
| 2 068 129 | 11/1992 | Canada . |
| 489 809 | 6/1992 | European Pat. Off. . |
| 512 501 | 11/1992 | European Pat. Off. . |
| 0 566 956 | 10/1993 | European Pat. Off. . |
| 32 03 491 | 8/1983 | Germany . |
| 39 07 391 | 9/1990 | Germany . |
| 39 07 392 | 9/1990 | Germany . |
| 42 37 501 | 5/1994 | Germany . |
| 43 23 771 | 1/1995 | Germany . |
| 43 23 908 | 1/1995 | Germany . |
| WO 91/03531 | 3/1991 | WIPO . |

OTHER PUBLICATIONS

Chemical Abstract No. 115:118225 which is an abstract of the Hori et al article entitled "Corrosion Prevention By Guanidine Salts" (1991).

Oberfläche — Surface, 1989, 4, pp. 8–12.

*Primary Examiner*—Anthony Green

*Attorney, Agent, or Firm*—Ernest G. Szoke; Wayne C. Jaeschke; Daniel S. Ortiz

[57] ABSTRACT

A method for the temporary protection of metal surfaces from corrosion is provided in which the metal surface to be temporarily protected from corrosion is coated with a guanidinium salt of an unsaturated fatty acid containing 6 to 44 carbon atoms.

20 Claims, No Drawings

USE OF GUANIDINIUM SALTS OF UNSATURATED FATTY ACIDS AS CORROSION INHIBITORS

FIELD OF THE INVENTION

This invention relates to oil-based corrosion inhibitors for metallic surfaces, more particularly iron-based surfaces, which are preferably used in the form of oil-in-water emulsions. The invention provides alkylamine-free corrosion inhibitors which are distinguished by good oil solubility and which, at the same time, emulsify the oil phase in water.

RELATED ART

Rust-control emulsions are used for temporarily protecting metals against atmospheric corrosion-inducing influences. They essentially contain nonpolar or polar oils, emulsifiers, corrosion inhibitors and water. Their effect is based on the adsorption of inhibitor molecules to the metal surface and on the formation of a protective film of emulsion components which acts as a diffusion barrier against atmospheric oxygen and water. In "Oberfläche-Surface" 1989, No. 4, pages 8–12, T. Förster et al. report on modes of action of and tests for rust-control emulsions.

Conventional corrosion-control formulations contain such components as, for example, petroleum sulfonates, salts of alkyl sulfonamidocarboxylic acids and amine or other salts of partial esters of alkyl or alkenyl succinic acid. For example, EP-A-566 956 describes corrosion-control formulations based on an amine-free salt of a semiester of an alkyl or alkenyl succinic acid.

Sulfur-containing corrosion inhibitors such as, for example, alkyl aryl sulfonic acids, petroleum sulfonates or salts of alkyl sulfonamidocarboxylic acids have the disadvantage that they can readily be degraded by microorganisms, such as sulfur-reducing bacteria, which can lead to serious odor emission problems. Alkylamine-containing corrosion-control formulations, particularly those containing secondary amines, are attracting increasing criticism on account of the risk of the formation of health-endangering nitrosamines. Accordingly, there is a need for sulfur-free and alkylamine-free corrosion inhibitors. Stearic acid derivatives have been described as corrosion inhibitors for purely oil-based systems, for example lubricating oils and lubricating greases (DE-C-32 03 491). Examples of the stearic acid derivatives in question are 9,10-dihydroxystearic acid and alkali metal salts and oligomeric condensates thereof, 9,10-epoxystearic acid, alkali metal salts and oligomeric "Estolids" thereof and, finally, mixed oligomers of 9,10-epoxy and 9,10-dihydroxystearic acid.

Corrosion-control formulations intended to be used in the form of oil-in-water emulsions may be marketed as purely oil-based, i.e. water-free, concentrates so that they may be brought into the ready-to-use emulsion form by addition of water at the point of use. These oil concentrates contain the corrosion inhibitors which, accordingly, have to be oil-soluble. To ensure that the oil concentrates are able spontaneously to form an emulsion on dilution with water, i.e. are self-emulsifying, it has hitherto been necessary for the concentrates to contain emulsifiers in addition to the corrosion inhibitors. Possible interactions between the surface-active emulsifiers and the polar corrosion inhibitors often have an adverse effect on emulsifying behavior and on the corrosion-control effect and, as a result, complicate formulation of the product. This problem could be eliminated if oil-soluble corrosion inhibitors with emulsifying properties could be made available.

Guanidinium salts of unsaturated fatty acids and processes for their production are known from U.S. Pat. No. 2,978,415. These guanidine soaps of unsaturated fatty acids are used as so-called boosters in the cleaning of textiles with solvents, i.e. in dry cleaning. A corrosion-inhibiting effect and emulsifying power are of no significance for this particular application which takes place in purely organic phase. Accordingly, the US patent in question does not contain any data on a corresponding effect of the guanidine soaps of unsaturated fatty acids.

BRIEF DESCRIPTION OF THE INVENTION

The problem addressed by the present invention was to provide new sulfur-free and alkylamine-free corrosion inhibitors of which oil solutions would not have unacceptably high viscosities, even at high active-substance concentrations, and which at the same time would emulsify the oil phase on the addition of water without any need for additional emulsifiers to be used.

This problem has been solved by the use of guanidinium salts of mono- or polyunsaturated fatty acids containing 6 to 44 carbon atoms for obtaining temporary protection against corrosion on metal surfaces, preferably iron-based surfaces.

DETAILED DESCRIPTION OF THE INVENTION

In the context of the invention, fatty acids are understood to be carboxylic acids which may optionally be OH-substituted. The unsaturated fatty acids suitable for use in accordance with the invention may be divided into two groups, namely: native fatty acids, which occur as a component of natural oils and fats, and so-called dimer fatty acids which are obtainable by generally acid-catalyzed dimerization of saturated fatty acids. Accordingly, the unsaturated fatty acids suitable for use in accordance with the invention are characterized on the one hand in that they represent native fatty acids, i.e. are branched or, preferably, linear, have 1 to 6 and preferably 1 to 3 double bonds and contain preferably 11 to 28 and, more preferably, 18 to 22 carbon atoms. Suitable unsaturated fatty acids of this type are preferably monobasic and are selected, for example, from undecylenic acid, myristoleic acid, palmitoleic acid, oleic acid, ricinoleic acid, erucic acid, linoleic acid, linolenic acid, arachidonic acid and mixtures thereof. On the other hand, unsaturated fatty acids from the group of so-called dimer acids are also suitable. These acids are polybasic and preferably dibasic. Dimer acids containing 36 to 44 carbon atoms are particularly suitable.

Guanidinium salts of defined pure fatty acids may be used with advantage for the purpose according to the invention. For economic reasons, however, guanidinium salts of technical fatty acid mixtures which may contain certain amounts of saturated fatty acids in addition to unsaturated fatty acids differing in their carbon chain lengths will be used in practice. Technical fatty acid mixtures such as these may be obtained, for example, by the hydrolysis of suitable natural oils and fats. For the use according to the invention, however, at least 50% by weight and preferably at least 80% by weight of the technical fatty acid mixtures must consist of unsaturated fatty acids with the carbon chain lengths mentioned.

The so-called dimer fatty acids which may also be used in accordance with the invention are generally not pure substances either, but may contain fatty acids differing in their carbon chain lengths and/or their degrees of oligomerization. Besides the actual dimer fatty acids, trimerization or polymerization products, for example, may be present alongside unreacted and/or isomerized monomer fatty acids. Dimer fatty acids in the context of the invention are understood to be product mixtures of which at least 50% by weight and preferably at least 70% by weight consist of dimer fatty acid with a carbon chain length of 36 to 44. Products such as these are commercially available, for example from the Unichema under the product group name of Pripol® or from Henkel KGaA under the product group name of Empol®.

For their use in accordance with the invention, the guanidinium salts of the above-mentioned fatty acids are employed as solutions in hydrocarbons liquid at the working temperature, substantially water-insoluble dialkyl ethers and/or acetals and mixtures thereof. Other oil phases suitable for dissolving the guanidinium salts of unsaturated fatty acids are ester oils such as, for example, oleyl oleate, products of the esterification of aliphatic dicarboxylic acids (preferably $C_{8-9}$) with branched Guerbet alcohols (preferably $C_{12-20}$) (EP-A-489 809), esters of $C_{1-5}$ monocarboxylic acids with monohydric or polyhydric alcohols (described, for example, in DE-A-39 07 391), esters of $C_{6-11}$ monocarboxylic acids with monohydric or polyhydric alcohols (described, for example in DE-A-39 07 392) and products of the alkoxylation of triglycerides with 0.5 to 3 moles of EO and/or PO, for example glycerol propoxylate trioleate (German patent application P 43 23 771). Also suitable are substantially water-insoluble saturated or unsaturated $C_{6-36}$ fatty alcohols which are liquid at the working temperature. In their case, both simple alcohols and α, ω-diols may be used.

These essentially water-insoluble solvents are referred to hereinafter as "oil-like solvents".

Solutions containing between 1 and 45% by weight of dissolved guanidinium salts of unsaturated fatty acids are preferably used. With lower contents, there is a distinct reduction in the corrosion-inhibiting effect whereas, with higher contents, the solutions generally become so highly viscous that their handling and their use for emulsion formation are unnecessarily complicated. However, higher concentrations may also be used for the purposes of the invention providing the attendant difficulties of emulsion formation are accepted, for example preliminary heating of concentrate and mixing water and the use of technical emulsification aids, for example high-speed toothed disks or ultrasound.

Suitable oil-like solvents for the guanidinium salts of unsaturated fatty acids are, for example, hydrocarbons which are liquid at the working temperature, i.e. at a temperature of about 10 to about 90° C. Examples of such hydrocarbons are paraffin oil or mineral oil. In the latter case, low-aromatic mineral oils are preferred for ecological and technological reasons. Suitable oils of this type are commercially available and include, for example, Pionier öl 4556, a product of Hansen & Rosenthal, Enerpar 3036, a product of Deutsche BP, and Parex Paraffin II, a product of Leuna-Werke.

Other suitable oil-like solvents for the guanidinium salts of unsaturated fatty acids are substantially water-insoluble dialkyl ethers which are liquid at the working temperatures mentioned above. By "substantially water-insoluble" are meant dialkyl ethers of which no more than 5% by weight and preferably no more than 0.5% by weight dissolve in water. Suitable examples are dialkyl ethers containing 6 to 24 and preferably 8 to 18 carbon atoms per alkyl group, the alkyl groups independently of one another being linear or branched, saturated or unsaturated and preferably being n-octyl, 2-ethyl-hexyl, stearyl and/or isostearyl groups. The dialkyl ethers may contain free hydroxyl groups, in which case they are referred to as hydroxy mixed ethers. The use of such dialkyl ethers in liquids for treating metals is described, for example, in German patent application P 42 37 501. Dialkyl ethers of the type in question are commercially available, for example from Henkel KGaA under the name of Cetiol-OE (dioctyl ether).

Other suitable oil-like solvents for the use of the guanidinium salts in accordance with the invention are acetals based on monofunctional aldehydes containing 1 to 25 and preferably 1 to 10 carbon atoms and monohydric alcohols containing 1 to 25 and, more particularly, 2 to 20 carbon atoms. The use of such acetals as a mineral oil substitute, as an oil component or as a base oil in lubricating oils and in liquids for treating metals is known from EP-A-512 501. A general process for the production of such acetals is also disclosed in this document.

For their use in accordance with the invention, the guanidinium salts of unsaturated fatty acids are preferably used in the form of a solution in one of the oil-like solvents mentioned above or in mixtures thereof as the oil phase of an oil-in-water emulsion. The oil phase, i.e. the solution of the guanidinium salts of the unsaturated fatty acids, preferably makes up from 0.5 to 50% by weight and more preferably from 5 to 20% by weight of the emulsion. A rule of thumb in this regard is that the quantity of oil phase present can be smaller, the higher the concentration of the guanidinium salts of unsaturated fatty acids in the oil phase. Good corrosion control results are obtained, for example, when an oil-in-water emulsion containing 10% by weight of oil phase is used, the oil phase having a concentration of a guanidinium salt of an unsaturated fatty acid, for example guanidinium oleate, of 5 to 20% by weight.

By adding glycols, the viscosity of the solutions of the guanidinium salts of unsaturated fatty acids in the oil-like solvents can be adjusted to applicationally favorable values without their ability to form an emulsion with water being influenced in any way. Suitable glycols are, for example, butyl diglycol, hexylene glycol or dipropylene glycol which may be added to the guanidinium salt solution in quantities of 1 to 10% by weight. The glycols may be added either to the solution of the guanidinium salts of unsaturated fatty acids in oil-like solvents or to the oil-like solvent before the reaction of guanidinium salts of volatile acids with unsaturated fatty acids described in the following. By virtue of its favorable effect on corrosion control, hexylene glycol is preferably used.

The present invention also relates to the oil-in-water emulsions suitable for the use of guanidinium salts of unsaturated fatty acids in accordance with the invention. However, the suitability of such emulsions for use in the treatment of metals goes beyond this particular application. For example, the emulsions may be used as cooling lubricant emulsions in the machining of metals, in which case the emulsions may contain other active substances known for this particular application, including for example lubrication-enhancing additives or biocides.

Accordingly, the present invention also relates to oil-in-water emulsions of which the oil phase is an oil-like solvent or solvent mixture and contains the guanidinium salts of unsaturated fatty acids in dissolved form in concentrations of 1 to 45% by weight and preferably 5 to 20% by weight, based on the oil phase, the oil phase making up from 0.5 to 50% by weight and preferably from 5 to 20% by weight of the emulsion.

The emulsions are preferably prepared by mixing a solution of the guanidinium salts in the oil-like solvent with water. Since the guanidinium salts are soluble both in the oil-like solvents and in water, they are distributed between the water phase and the oil phase. In each individual case, the distribution equilibrium depends upon the oil-like solvent selected and upon the type of the unsaturated fatty acid. As described in Example 11, an emulsion can also be obtained by emulsifying an aqueous solution of the guanidinium salts with oil. In this case, too, a distribution equilibrium of the guanidinium salts can be expected to be established.

The oil phase containing the guanidinium salts of unsaturated fatty acids in at least partly dissolved form makes up about 0.5 to about 50% by weight and preferably about 5 to about 20% by weight of the oil-in-water emulsion. An emulsion such as this is normally stable without other co-emulsifiers for the periods of several hours required for application. In special cases, for example where the emulsion contains other active substances, for example builder salts, or impurities arising out of its use, the emulsion may have to be stabilized by the use of additional co-emulsifiers. Suitable co-emulsifiers are nonionic surfactants, more particularly ethoxylation products of fatty alcohols, for example a product of the addition of 6 moles of ethylene oxide to 1 mole of a $C_{12/14}$ fatty alcohol mixture, or anionic emulsifiers, for example alkyl benzene sulfonates. The necessary quantities are determined by the other components of the emulsion and have to be determined by tests. The use of up to 20% by weight of co-emulsifier, based on the quantity of the oil solution, may be taken as a guide value.

The emulsion may be present in the form of a conventional milky to opaque emulsion. For special applications, it can also be of advantage to use the emulsion in the form of an almost transparent so-called micro-emulsion with an oil content of up to 50% by weight of the type obtainable by phase inversion from a water-in-oil emulsion. This phase inversion, which can be induced for example by varying the temperature, is also known as the PIT (phase inversion temperature) method. It is described in detail in German patent application P 43 23 908. A variant of this process is described in Example 11 below.

The production of the guanidinium salts of unsaturated fatty acids is described in U.S. Pat. No. 2,978,415 which was cited earlier on. For example, a mixture of unsaturated fatty acids may be dissolved in an organic solvent, such as methyl isobutyl ketone, and guanidinium carbonate may be added to the resulting solution. On completion of the reaction, which is accompanied by the elimination of water and $CO_2$, both the solvent and the water of reaction may be removed, the product remaining behind in the form of a brown wax-like paste. For the use according to the invention, it is advisable to use volatile acids, for example guanidinium carbonate, as solvents for the reaction of the unsaturated fatty acids with guanidinium salts and directly to employ oil-like solvents as the oil-phase to be used for the subsequent formation of the emulsion. A corresponding production example is described in the following.

Depending on the oil-like solvent used, it can be advisable to remove the water of reaction formed during the reaction of guanidinium carbonate with the fatty acid more or less completely from the reaction product because the viscosities of the solutions obtained can depend to a large extent upon their water content. The optimal production procedure (heating, application of vacuum) depends on the one hand upon the unsaturated fatty acid or fatty acid mixture used and, on the other hand, upon the oil-like solvent used and has to be empirically determined for each particular case.

It is of advantage, when preparing the solutions of guanidinium salts of unsaturated fatty acids in the oil-like solvent, to obtain homogeneous liquids of which the viscosity enables them to be allowed to run into water without any need for other technical emulsion-forming measures. Highly viscous paste-like systems are more difficult to handle and, accordingly, are less preferred. Guanidinium salts of saturated fatty acids which are known as corrosion inhibitors are unsuitable for the use according to the invention because their oil solutions in the concentration ranges according to the invention are wax-like pastes rather than free-flowing liquids.

EXAMPLES

Example 1

This Example describes the preparation of a guanidinium oleate solution in mineral oil containing 38% by weight of the salt in accordance with U.S. Pat. No. 2,978,415. In a heatable stirred reactor with a nitrogen inlet, 610.6 g of technical oleic acid with an acid value of 202 (Edenor® TiO5GA, Henkel KGaA, Düsseldorf), corresponding to 2 moles+10% excess, are mixed with 1096 g of mineral oil (Pionierol 4556, Hansen & Rosenthal). 180 g (1 mole) of guanidinium carbonate (Linz Chemie, Linz, Austria) are introduced in portions with stirring at room temperature under a nitrogen blanket. After the addition, the reaction mixture is heated to 100° C. and stirred until the acid value is below 20 (about 2 hours). During the reaction, there is a slight evolution of gas and the solution changes color from light yellow to beige-brown. Theoretically, the elimination of 1 mole of carbonic acid corresponding to 1 mole of $H_2O$ and 1 mole of $CO_2$, 62 g, is expected during the reaction. A high-viscosity, beige-brown, transparent oil solution is obtained as the reaction product.

Examples 2 to 4

Production was carried out in exactly the same way as in Example 1 except that the solvent was varied.

Example 2

Solvent: paraffinic process oil Enerpar 3036, Deutsche BP

Example 3

Paraffin oil Parex Paraffin II, Leuna-Werke

Example 4

Solvent, dioctyl ether Cetiol OE, Henkel KGaA.

Brown, transparent, high-viscosity but free-flowing liquids were obtained in every case.

Example 5

This Example describes the production of a guanidinium oleate solution in mineral oil containing 10% by weight of the salt in accordance with U.S. Pat. No. 2,978,415. In a heatable stirred reactor with a nitrogen inlet, 638 g of technical oleic acid with an acid value of 202 (Endenor® TiO5GA, Henkel KGaA, Düsseldorf), corresponding to 2 moles+15% excess, were mixed with 190 g of mineral oil (Pionierol 4556, Hansen & Rosenthal). 180 g (1 mole) of guanidinium carbonate (Linz Chemie, Linz, Austria) were introduced in portions with stirring at room temperature under a nitrogen blanket. After the addition, the reaction mixture is heated to 100° C. and stirred until the acid value is below 20 (about 2 hours). During the reaction, there is a slight evolution of gas and the solution changes color from light yellow to beige brown. After the main reaction, a water jet vacuum is applied (for 15 mins.) at 100° C. to remove $CO_2$ and water. The reaction mixture is diluted with 6620 g of mineral oil. A beige-brown transparent oil solution, from which emulsions can be prepared by addition of 90% by weight of water, is obtained as the reaction product.

Examples 6 to 10, Comparison Examples 1 to 3

The corrosion-inhibiting effect was tested by the condensation test according to DIN 50017 KFW. To this end, 5 cm×10 cm steel plates of the quality ST 1405 were brushed with an aqueous surfactant solution, rinsed with water and alcohol and dried. The plates were then immersed in oil solutions according to Examples 1 to 5. 20% by weight solutions of Ba Petronate 70 TBN (Witco) in oils according to the Table were used as Comparison Examples 1 to 3.

The test cycle began after a drainage time of 24 hours, the test plates being inspected daily for corrosion. The results are set out in the Table where "traces of corrosion" means that there are at most 3 corrosion spots on the surface, "slight corrosion" means that less than 20% of the surface is corroded and "serious corrosion" means that more than 20% of the surface is corroded.

TABLE

Corrosion Control Test — Condensation Test According to DIN 50017 KFW

| | Test Substance | Results |
|---|---|---|
| Example 6 | Product of Example 1 | Up to 13 days, no corrosion<br>Up to 24 days, traces of corrosion<br>After 25 days, terminated with slight corrosion |
| Example 7 | Product of Example 2 | After 25 days, terminated without any corrosion |
| Example 8 | Product of Example 3 | Up to 16 days, no corrosion<br>After 25 days, terminated with traces of corrosion |
| Example 9 | Product of Example 4 | Up to 15 days, no corrosion<br>After 25 days, terminated with traces of corrosion |
| Example 10 | Product of Example 5 | Up to 7 days, no corrosion<br>After 20 days, serious corrosion |
| Comp. 1 | Barium petroleum sulfonate in Pionieröl 4556 | After 1 day, serious corrosion (>20% corroded) |
| Comp. 2 | Barium petroleum sulfonate in Enerpar 3036 | Up to 2 days, no corrosion<br>Up to 3 days, traces of corrosion<br>After 5 days, terminated with serious corrosion |
| Comp. 3 | Barium petroleum sulfonate in Parex Paraffin II | Up to 1 day, traces of corrosion<br>After 5 days, terminated with serious corrosion |

Production and corrosion-inhibiting effect of emulsions The products of Examples 1 to 5 were diluted with deionized water in a ratio by weight of 1:9. Stable emulsions were obtained. By contrast, no emulsions were formed when solutions of barium petroleum sulfonate in oils were added in accordance with Comparison Examples 1 to 3.

The corrosion-inhibiting effect of an emulsion obtained by adding water to the product of Example 5 in a ratio by weight of 1:9 was tested as in Example 10. After 7 days, no corrosion was observed; after 20 days, serious corrosion was observed.

Viscosity regulation

To adjust the viscosities of the products of Examples 1 to 5, glycols (for example butyl diglycol, hexylene glycol, dipropylene glycol) were added to them in quantities of 5% by weight. The formation of emulsions on addition of water in a ratio by weight of 1:9 was not affected.

For corrosion testing as in Example 10, the product of Example 5 was mixed with 5% by weight of hexylene glycol. An emulsion was obtained by adding water in a ratio by weight of 1:9 and was used to test the corrosion-inhibiting effect. Result: no corrosion after 8 days, serious corrosion after 13 days.

Example 11

Production of a microemulsion by phase inversion

In a first step, solvent-free guanidinium oleate was prepared by mixing 90 g (=0.5 mole) of guanidinium carbonate with 281 g (=1 mole) of technical oleic acid, acid value 202 (Edenor® TiO5, Henkel KGaA, Düsseldorf) at room temperature in a stirred reactor. The temperature was increased to 150° C. over a period of 45 minutes with stirring and was left at that level for 3.5 hours. A yellow-brown wax-like product with an acid value of 5 was obtained.

To prepare a microemulsion by the phase inversion method, 2.6 parts by weight of this guanidinium oleate and 0.26 part by weight of sodium citrate were dissolved in 51.04 parts by weight of water. The solution was mixed while stirring with 40 parts by weight of mineral oil (Pionieröl 4556) and 6.1 parts by weight of emulsifier (product of the addition of 4 moles of ethylene oxide to a $C_{12/14}$ fatty alcohol mixture) at a temperature above the phase inversion temperature of 35° C. determined in preliminary tests and was cooled to below the phase inversion temperature. A transparent microemulsion was obtained and could be diluted by adding water.

We claim:

1. A method for protection of metal surfaces from corrosion which comprises applying to the metal surface to be protected guanidinium salts of unsaturated fatty acids containing 6 to 44 carbon atoms.

2. The method claimed in claim 1, wherein the unsaturated fatty acids comprise at least one member selected from the group consisting of native fatty acids and dimer fatty acids.

3. The method claimed in claim 2, wherein the native fatty acids comprise branched or linear fatty acids, having 1 to 6 double bonds and containing 11 to 28 carbon atoms.

4. The method claimed in claim 3, wherein the native fatty acids comprise a member selected from the group consisting of undecylenic acid, myristoleic acid, palmitoleic acid, oleic acid, ricinoleic acid, erucic acid, linoleic acid, linolenic acid, arachidonic acid and mixtures thereof.

5. The method claimed in claim 2, wherein the dimer fatty acids are polybasic acids containing 36 to 44 carbon atoms.

6. The method claimed in claim 1 wherein the guanidinium salts comprise a liquid solution in an essentially water-insoluble solvent selected from the group consisting of hydrocarbons liquid at the working temperature, substantially water-insoluble dialkyl ethers, substantially water-insoluble alcohols, substantially water-insoluble ester oils substantially water-insoluble acetals and mixtures thereof, in concentrations of 1 to 45% by weight.

7. The method claimed in claim 6, wherein the dialkyl ethers comprise alkyl groups which independently of one another are linear or branched, saturated or unsaturated groups and each alkyl group contains 6 to 24 carbon atoms.

8. The method claimed in claim 6, wherein the solvent for the guanidinium salts comprises at least one acetal based on a monofunctional aldehyde containing 1 to 25 carbon atoms and a monohydric alcohol containing 1 to 25 carbon atoms.

9. The method claimed in claim 6, wherein the solvent for the guanidinium salts comprises at least one member selected from the group consisting of paraffin oil and mineral oil.

10. The method claimed in claim 1 wherein the guanidinium salts of unsaturated fatty acids are dissolved in an oil-in-water emulsion, comprising an essentially water-soluble solvent comprising an oil phase, the oil phase comprising from 0.5 to 50% by weight of the emulsion and the guanidinium salts comprising from 1 to 45% by weight of the oil phase.

11. An oil-in-water emulsion comprising an oil phase comprising an essentially water-insoluble solvent comprising guanidinium salts of unsaturated fatty acids in dissolved form at a concentration of 1 to 45% by weight based on the weight of the oil phase, the oil phase comprising from 0.5 to 50% by weight of the emulsion.

12. An oil-in-water emulsion as claimed in claim 11, wherein the emulsion is a microemulsion formed by phase inversion.

13. The method of claim 10 wherein the solvent comprises a liquid selected from the group consisting of hydrocarbons, substantially water-insoluble dialkyl ethers, substantially water-insoluble alcohols, substantially water-insoluble ester oils, substantially water-insoluble acetals and mixtures thereof.

14. The method of claim 13, wherein the unsaturated fatty acids comprise at least one member selected from the group consisting of native fatty acids and dimer fatty acids.

15. The method of claim 14, wherein the native fatty acids comprise branched or linear fatty acids, having 1 to 6 double bonds and containing 11 to 28 carbon atoms.

16. The method of claim 15, wherein the native fatty acids comprise a member selected from the group consisting of undecylenic acid, myristoleic acid, palmitoleic acid, oleic acid, ricinoleic acid, erucic acid, linoleic acid, linolenic acid, arachidonic acid and mixtures thereof.

17. The method of claim 13, wherein the dimer fatty acids are polybasic acids containing 36 to 44 carbon atoms.

18. The method of claim 17, wherein the dialkyl ethers comprise alkyl groups which independently of one another are linear or branched, saturated or unsaturated groups and each alkyl group contains 6 to 24 carbon atoms.

19. The method of claim 13, wherein the solvent for the guanidinium salts comprises at least one acetal based on a monofunctional aldehyde containing 1 to 25 carbon atoms and a monohydric alcohol containing 1 to 25 carbon atoms.

20. The method of claim 14, wherein the solvent for the guanidinium salts comprises at least one member selected from the group consisting of paraffin oil and mineral oil.

* * * * *